US005239909A

United States Patent [19]

Bell et al.

[11] Patent Number: 5,239,909

[45] Date of Patent: Aug. 31, 1993

[54] MISSILE WEAPON SYSTEM

[75] Inventors: Richard E. Bell, Lisburne; William J. T. Reid, Killinchy, both of Ireland

[73] Assignee: Short Brothers PLC, Belfast, Northern Ireland

[21] Appl. No.: 838,458

[22] Filed: Mar. 11, 1992

[30] Foreign Application Priority Data

Sep. 15, 1989 [GB] United Kingdom ..... 8920960

[51] Int. Cl.[5] ..... F41F 3/077; F41F 3/042

[52] U.S. Cl. ..... 89/1.807; 89/89; 89/1.812; 89/1.816

[58] Field of Search ..... 89/1.806, 1.813, 1.816, 89/1.817, 1.818, 1.807, 1.812

[56] References Cited

U.S. PATENT DOCUMENTS

| | | | |
|---|---|---|---|
| 2,690,124 | 9/1954 | Melick | 89/1.806 |
| 3,398,639 | 8/1968 | Apothéloz | 89/1.806 |
| 3,754,726 | 8/1973 | Rusbach | 89/1.806 |
| 3,811,360 | 5/1974 | Ricks | 89/1.807 |
| 4,271,748 | 6/1981 | Ward | 89/1.812 |
| 4,301,708 | 11/1981 | Mussey | 89/1.817 |
| 4,455,917 | 6/1984 | Shook | 89/1.817 |

FOREIGN PATENT DOCUMENTS

| | | |
|---|---|---|
| 1495805 | 9/1967 | France . |
| 2091471 | 1/1972 | France . |
| 843037 | 8/1960 | United Kingdom . |
| 843038 | 8/1960 | United Kingdom . |
| 1160529 | 8/1969 | United Kingdom . |
| 1340386 | 12/1973 | United Kingdom . |

*Primary Examiner*—David H. Brown
*Attorney, Agent, or Firm*—Kenyon & Kenyon

[57] ABSTRACT

A missile is housed in a launcher from which it is launched by efflux gases from a thrust motor of the missile. A closure device is secured by retaining screws in a position in which it closes off the rear end of the missile and embodies a thrust generating cartridge which is fired to propel the device clear of the rear end of the missile. The closure device comprises a demand cap and base plate and the cartridge generates thrust first to release the cap and plate from the screws and then to displace the domed cap relative to the base plate to bring them to a disposition in which the momentum of the domed cap is imparted to the complete closure device thereby to propel the cap and the plate together at velocity determined by the motion of the domed cap relative to the base plate.

17 Claims, 4 Drawing Sheets

MISSILE WEAPON SYSTEM

The present invention relates to a missile weapon system and is particularly although not exclusively concerned with a weapon system utilizing a launcher tube in which a missile is housed for storage and transportation and from which it is fired.

In a missile weapon system hitherto proposed, a missile is supplied in a missile launcher tube in which it is transported. In use, in the shoulder launch mode, an aiming unit is fitted to the launcher tube and the assembly is supported on the operator's shoulder. The operator directs the launcher towards a target and fires the missile from the launcher tube. In the non-shoulder launch mode, a plurality of missiles in their launcher tubes may be mounted on a fixed pedestal, on a variety of vehicles or on a ship, etc. and may be fired remotely by the operator.

It is important that the missile is adequately protected during stowage and transportation and in a system hitherto proposed the front and rear ends of the launcher tube are sealed by a front end cap and a rear end blow-out panel, the forward end cap being blown clear of the tube by gas pressure (separately supplied) and the rear end panel, which is secured to the rear end of the missile, being blown clear of the rear end of the tube by the efflux gases from the missile rocket motor upon firing. The rear end panel has served also to support the rear end of the missile within the tube and prevent it from radial and axial displacement during transportation.

While the weapon system above-described has functioned satisfactorily for many years, attention has been drawn to the fact that the rear blow-out panel is ejected from the end of the launcher tube with considerable force and represents a hazard to combat personnel or equipment in the immediate vicinity during launch.

It is an object of the present invention to provide a missile weapon system which does not in use give rise to the above-mentioned hazard.

According to the present invention there is provided a missile weapon system comprising a missile launcher, a missile which is housed in the launcher and from which it is launched under thrust produced by efflux gases from a thrust motor of the missile, a closure device, and securing means for securing the closure device in a closed position in which it closes off the rear end of the missile, the closure device embodying thrust generating means for applying a thrust to the closure device at the time the missile is fired to propel the device from the closed position to a remote position clear of the rear end of the missile.

Preferably, the closure device is arranged to be propelled by the thrust from the thrust generating means from the closed position to the remote position by ejection of the device from the rear end of the missile rearwardly and axially with respect to the missile.

In an embodiment of the invention hereinafter to be described, the closure device comprises first and second elements displaceable with respect to each other between a first disposition which they take up in the closed position of the device and in which they are held by the securing means and a second disposition which they take up following release form the securing means by a displacement of the first element relative to the second element and at which the first element is prevented from further relative displacement by the second element, the thrust generating means generating thrust first to release the elements from the securing means and then to displace the first element relative to the second element to bring the two elements to their second disposition at which the momentum imparted to the first element by the thrust from the thrust generating means is imparted to the closure device to propel the closure device to the remote position at an initial velocity determined by the motion of the first element relative to the second element.

In the embodiment of the invention hereinafter to be described, the first element is located to the rear of the second element, the securing means secures the first element to the rear end of the missile with the second element held captive against the rear end of the missile by the first element, and displacement of the first element relative to the second element is a rearward displacement.

In the embodiment of the invention hereinafter to be described, the securing means comprises a plurality of retaining members which are secured to the rear end of the missile at equi-spaced positions around the rear of end of the missile and extend through the first element and the retaining members serve to clamp the first element to the rear end of the missile with the second element being held captive between the first element and the rear end of the missile.

In the embodiment of the invention hereinafter to be described, each retaining member comprises a locally weakened retaining screw which extends through the first element of the closure device and is screwed into a threaded bore in the rear end of the missile to bring a head of the screw to bear against a rear face of the first element and each retaining member is arranged to fracture at the locally weakened region when the first element is subjected to rearwardly directed thrust produced by the thrust generating means.

Preferably, the second element of the closure device includes arrestor means to arrest displacement of the first element in the second disposition of the elements, and the arrestor means are adjustable to provide for an adjustment of the displacement of the first element in moving from the first disposition to the second disposition, thereby to provide for an adjustment of the initial ejection velocity of the closure device from the rear end of the missile. The arrestor means may then comprise a plurality of arrestor members which are secured to the second element at equi-spaced positions around the rear end of the missile and pass through bores in the first element, each arrestor member carrying an arrestor part at such location on the arrestor member as to provide for displacement of the first element from the first disposition of the elements in which the first element is clamped to the missile and in which the second element bears against the rear end of the missile, to the second disposition in which the rear face of the first element bears against the arrestor part.

In the embodiment of the invention hereinafter to be described each arrestor member comprises a stud which is screwed into the second element of the closure device and extends rearwardly through a bore in the first element of the device, with the arrestor part taking the form of an arrestor nut screwed on to the rear end of the arrestor stud projecting rearwardly from the first element, the arrestor nuts being adjustable to provide for an adjustment of the displacement of the first element in moving from the first disposition to the second disposition, thereby to provide for an adjustment of the initial ejection velocity of the closure device from the rear end of the missile.

Preferably, the first and second elements together form an annular thrust chamber for pressurised gas and the thrust generating means comprises a gas generator for discharge of pressurised gas into the thrust chamber. The second element of the closure device may then be in the form of a base plate and the first element in the form of a domed cap which is arranged on the base plate for axial sliding with respect thereto between the first and second dispositions of the two elements, the gas generator being mounted on the base plate and communicating with the thrust chamber through vents in a wall enclosing the generator.

In the embodiment of the invention hereinafter to be described, the missile launcher includes a launcher tube within which the missile is housed and from which it is launched under thrust produced by efflux gases from the thrust motor of the missile and the closure device then further serves in the closed position to close off the launcher at the rear end thereof. The closure device may then further serve by engagement with the rear end of the launcher tube to provide support for the missile within the tube. For this purpose, the closure device may include support means which engages the inner wall of the launcher tube to provide support for the missile against lateral and longitudinal displacements of the missile within the tube.

The support means may be made resilient and serve to absorb shocks and vibration imposed upon the launcher tube during transportation. For this purpose, the support means may comprise a support ring made of a resilient material which extends around the closure device and which is forced into a circumferential groove formed in the inner wall of the tube, when the closure device is clamped to the rear end of the missile and takes up its closed position closing off the rear end of the missile.

One embodiment of the invention will now be described by way of example with reference to the accompanying drawings in which.

Figure 1:
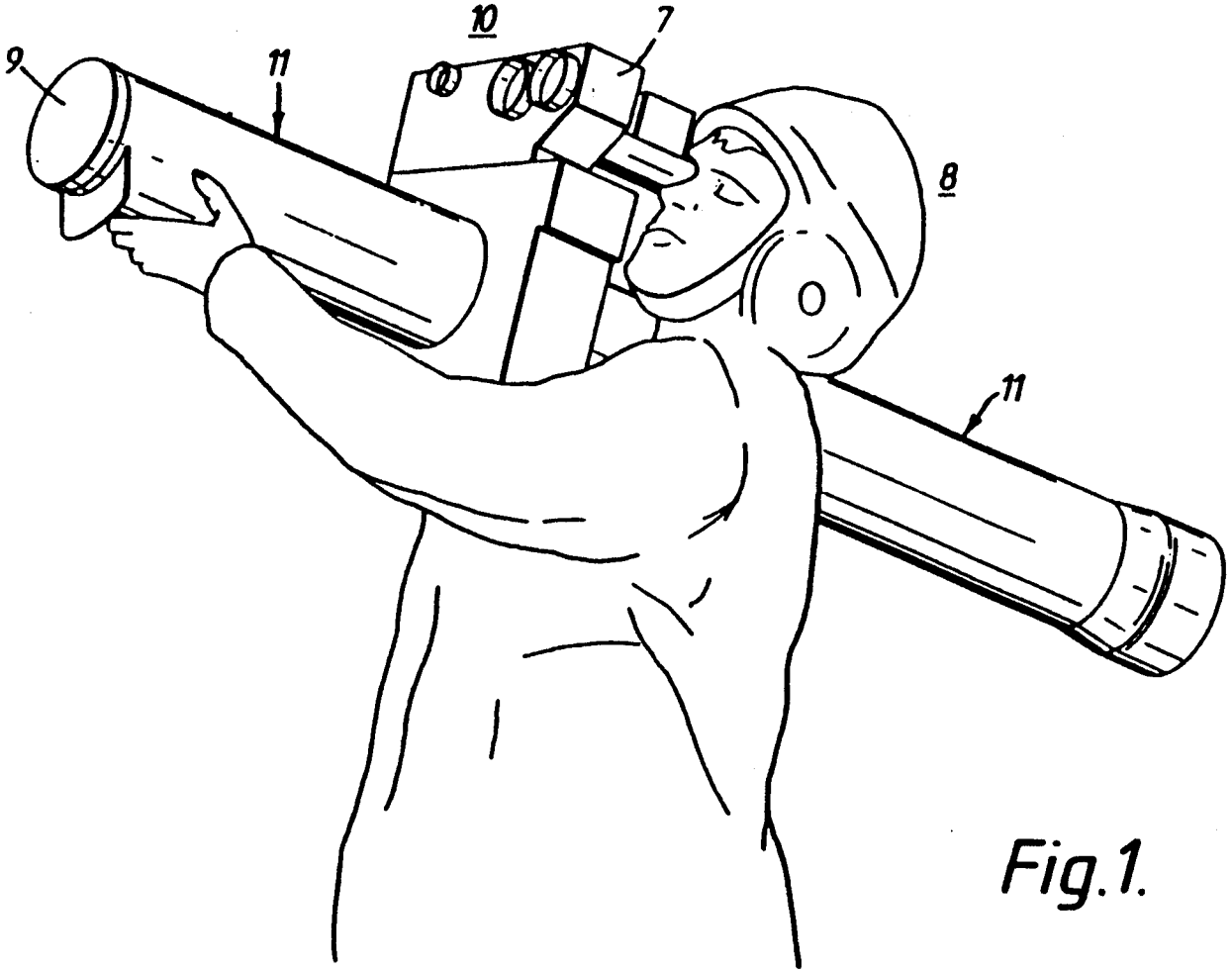
FIG. 1 is a schematic perspective view of a man portable shoulder-launched guided missile weapon system according to the invention, shown supported on the shoulder of an operator ready for the launching of a missile.

Referring first to FIG. 1, a man portable shoulder-launched weapon system 10 comprises a missile launcher tube 11 which carries an operator's aiming unit 7 and which is supported as shown by an operator 8 who rests the launcher tube 11 on his right shoulder and supports the forward section of the launcher tube with his left hand. In this position, he directs the launcher tube 11 toward the target to be engaged, using the aiming unit 7 which is fixedly mounted on the launcher tube 11. The missile (not shown) is contained within the launcher tube 11 and during, for example, an engagement of a hostile aircraft the operator tracks the aircraft by maintaining it in his field of view in the aiming unit 7 by appropriately swinging round with the launcher tube 11 and adjusting the angle of elevation of it, and then fires the missile, which he guides to the target using the aiming unit 7. The front end of the launcher tube 11 is sealed by a cap 9 which is ejected before the missile is launched from the tube 11.

Figure 2:
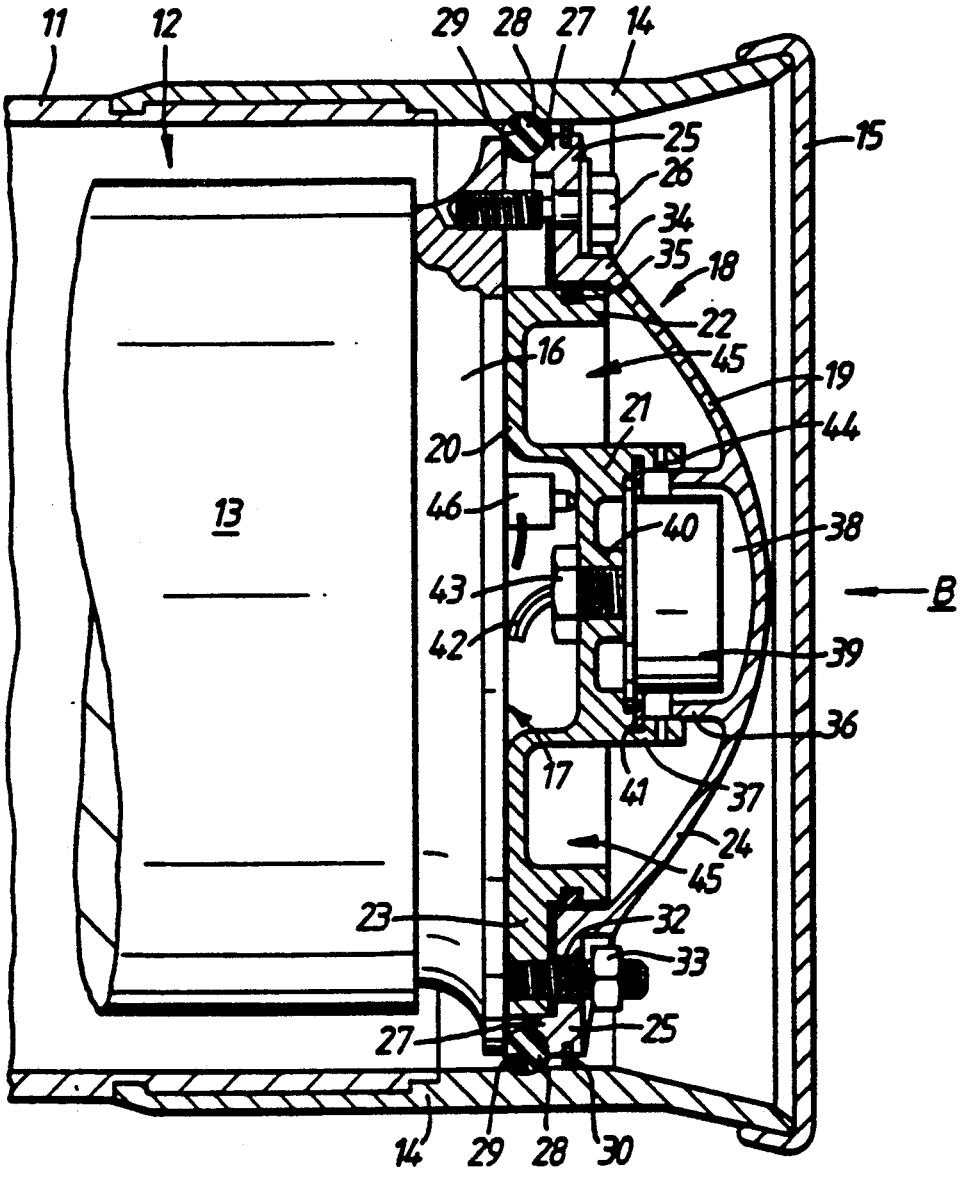
FIG. 2 is a schematic part cross-sectional side elevation of the rear of a missile launcher tube and the rear of a missile of a weapon system according to the invention, the sections being aligned and taken on the lines A—A in FIG. 3.

Referring now to FIG. 2, the rear section of the launcher tube 11 is shown together with the rear section of a missile 12 housed within it, the missile motor being shown and indicated by the reference numeral 13.

The rear section of the launcher tube 11 terminates in a frustoconical outlet end 14 which produces a venturi effect on efflux gases discharged from the first stage motor 13 following firing of the missile. The outlet end 14 is provided with a lightweight snap-fit protection cover 15 which can be removed for inspection of parts located within the rear end of the tube 11.

The rear end of the first stage motor 13 terminates in an nozzle plate 16 which includes outlet nozzles (not shown) for the discharge of efflux gases from the motor 13. A closure device 18 closes off the rear end face 17 of the nozzle plate 16 of the motor 13 to protect the missile from ingress of moisture and dust and other contaminants during stowage and transportation.

Figure 3:
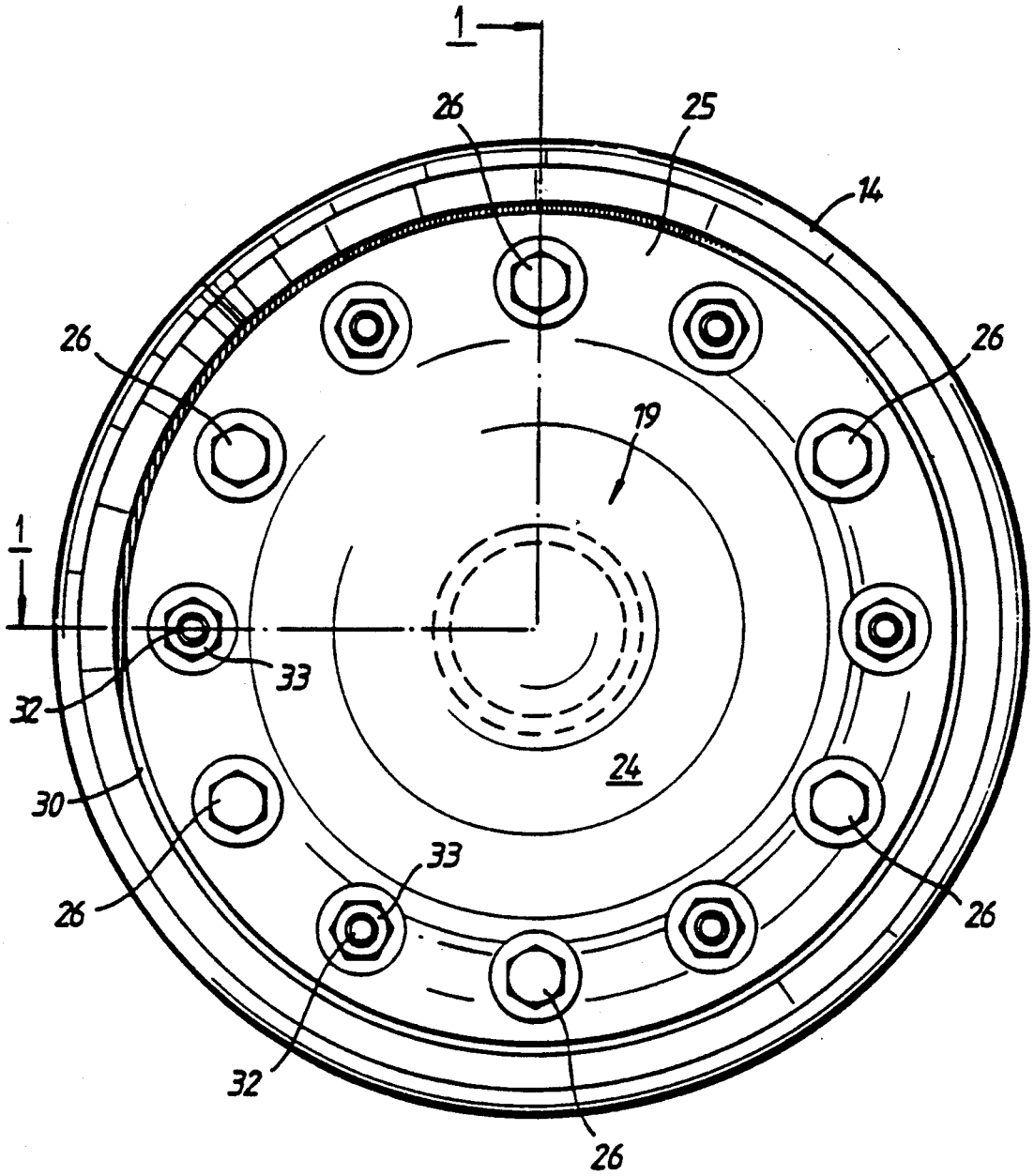
FIG. 3 is a schematic end view of the launcher tube and missile shown in FIG. 1, viewed in the direction of the arrow B in FIG. 2, illustrating a closure device for the missile.
Figure 4:
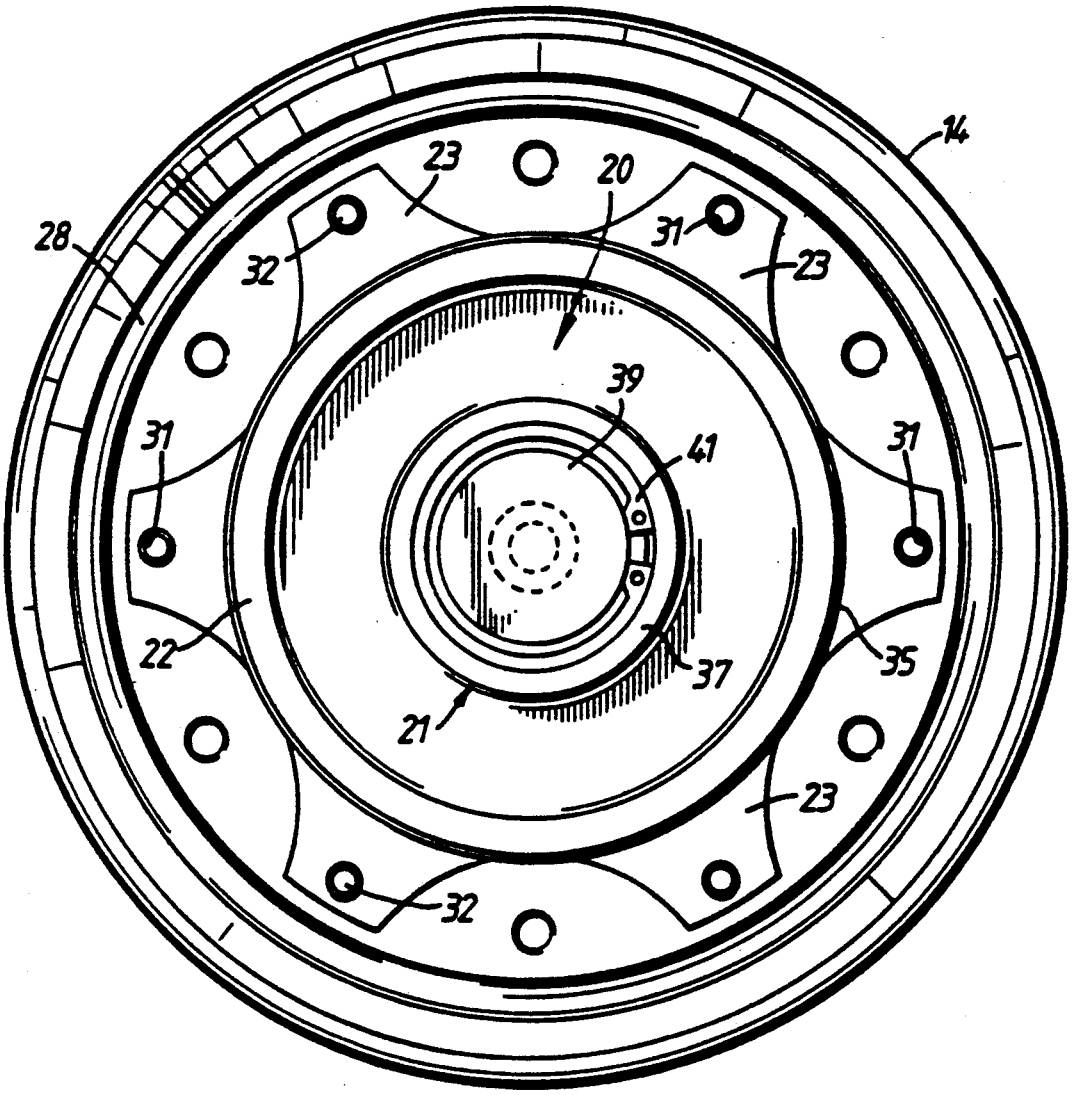
FIG. 4 is a schematic end view corresponding to that shown in FIG. 3 illustrating a part of the closure device for the missile.

Referring again to FIG. 2, as well as to FIGS. 3 and 4, the closure device 18 comprises a domed cap 19 having a configuration in plan as shown in FIG. 3 and a base plate 20 which has a configuration in plan as shown in FIG. 4. As will be seen, the base plate 20 includes a rearwardly extending central boss 21, a cylindrical rearwardly extending wall 22 and a plurality of radially extending flanges 23, while the domed cap 19 comprises a domed portion 24 and a radially extending circumferential flange 25 which is arranged to seat on the base plate 20.

The domed cap 19 extends over the base plate 20 and both the cap 19 and the base plate 20 are secured to the nozzle plate 16 of the first stage motor 13 by six locally weakened retaining screws 26 which pass through bores in the flange 25 of the cap 19 and threadingly engage in threaded bores in the nozzle plate 16 of the first stage motor 13.

It will be seen that the flange 25 of the cap 19 engages over the wall 22 of the base plate 20. Furthermore, the flange 25 is formed with a forwardly extending cylindrical wall 27, which engages over the flanges 23 of the base plate 20 and which provides an engagement surface for a support ring 28 which is brought to bear against the circumferential outer edge of the nozzle plate 16. The ring 28 is made of a resilient material such as rubber and is driven into a circumferential groove 29 formed in the inner surface of the venturi 14 when the retaining screws 26 are tightened to clamp the domed cap 19 to the nozzle plate 16 and the venturi 14 via the support ring 28. In addition, an environmental seal 30 is provided in the flange 25 of the cap 19 so that it engages the inner surface of the nozzle 14 to provide protection against ingress of moisture and other environmental contaminants.

As best seen in FIGS. 2 and 4, the flanges 23 of the base plate 20 are provided with tapped holes 31 for the reception of six screw threaded studs 32, which are screwed into the holes 31 and pass rearwardly through aligned bores in the cap 19, terminating to the rear of the flange 25 of the cap 19, where they are provided with arrestor nuts 33 which are screwed on to the studs 32. As will be seen from FIG. 3, the studs 32 with their arrestor nuts 33 are arranged in equi-spaced positions around the flange 25 of the cap 19 between the retaining screws 26 which are similarly arranged in equi-spaced locations around the flange 25.

It will be seen that the flange 25 of the cap 19 extends radially outwardly from a cylindrical wall 34 which forms the base of the domed portion 24 of the cap 19 and which slidingly engages over the cylindrical wall 22 on the base plate 20 to provide for a limited axial displacement of the cap 19 with respect to the base plate 20 from the position shown in FIG. 2 to a position in which the rear face of the flange 25 bears against the arrestor nuts 33, when the cap 19 is no longer held by the retaining screws 26. In addition, an O-ring seal 35 is provided between the walls 22 and 34.

The domed portion 24 of the cap 19 further includes a forwardly extending cylindrical wall 36, the outer face of which slidably engages with the inner face of a rearwardly extending cylindrical wall 37 formed in the boss 21 of the base plate 20. In a chamber 38 formed by the walls 36 and 37 there is mounted a gas generator cartridge 39 which is mounted on an inner boss 40 formed in the base plate 20 and which is held in place by a circlip 41, with electrical leads 42 for ignition of the cartridge 39 being supplied through a hollow screw 43 screwed into the boss 40.

Referring again to FIG. 1, the launcher tube 11 complete with the missile 12 contained in it is stowed separately from the aiming unit 7 and assembled by the operator in readiness for firing. The launcher tube 11 provides a launch platform for the missile 12 and also protects the missile against damage during handling and in harsh environmental conditions. Assembly of the missile 12 within the launcher tube 11 is, on the other hand, carried out at an assembly point where careful control can be exercised both as to environmental conditions and to the mounting of the missile 12 within the tube 11. The closure device 18 serves both to close off the rear end of the missile 12 as well as to provide lateral and longitudinal support for the missile 12 within the tube 11.

Prior to the mounting of the missile 12 within the tube 11, the rubber support ring 28 is positioned in its groove in the venturi 14. The missile is then inserted into the tube 11 until the nozzle plate 16 abuts with the rubber support ring 28. The closure device 18 is fitted and secured by engaging the retaining screws 26 in the threaded bores in the rear face of the nozzle plate 16. The retaining screws 26 are then torque tightened down to bring and the wall 27 of the flange 25 to bear down on the support ring 28 to force it into engagement with the annular groove 29 in the outlet nozzle 14. In the clamped position of the closure device 18 shown in FIG. 2, the base plate 20 is contained between the nozzle plate 16 and the flange 25 of the domed cap 19 and is attached to the domed cap 19 by the studs 32 and nuts 33. It will however be seen that in this position the rear face of the flange 25 is spaced by a predetermined distance from the arrestor nuts 33. The environmental seal 30 also takes up the position shown.

When the missile is to be fired, the operator 8 actuates a firing button on the aiming unit 7 and commences a firing sequence controlled by a firing circuit which first applies a firing signal on leads 42 to produce ignition of the gas generator cartridge 39. As a result, the chamber 38 fills with gas under high pressure which passes through vents 44 in the wall 37 of the base plate 20 and into an outer annular chamber 45 bounded by the dome portion 24 of the cap 19 and the base plate 20, which it fills at a lower pressure. The pressurised gas in the chamber 45 applies a thrust to the domed cap 19, pushing it away from the base plate 20 and the gas is arranged to reach a pressure which will cause the retaining screws 26 to fracture at locally weakened neck portions. Upon removal of the constraint applied by the retaining screws 26, the domed cap 19 is then displaced rearwardly under the thrust produced by the pressurised gas in the chamber 45 and gathers kinetic energy by its motion, until it strikes the arrestor nuts 33 which prevent it from further displacement relative to the base 20 and at which point its momentum is imparted to the complete closure device which then moves rearwardly with the cap 19 at a velocity which is set at a safe minimum value so that the ejected assembly does not represent a hazard.

It will be appreciated that the thrust produced by the pressurised gas in the outer chamber 45 of the closure device 18 must be sufficient to fracture the retaining screws 26 and a minimum thrust is required for this purpose. With the cap 19 released from constraint by the retaining screws 26, it becomes subject to that thrust and is accelerated to a velocity which can be expressed by the following equation:

$$Px = \frac{1}{2}mv^2$$

where P is the thrust, x is the displacement of the cap 19, m is the mass of the cap 19 and v is the velocity of the cap 19 at the end of its displacement.

For a predetermined thrust P sufficient to fracture the retaining screws 26, the displacement x can be set to cause the cap 19 to strike the arrestor nuts 33 with a predetermined velocity v so that the cap 19 imparts to the device 18 just sufficient energy as to propel the device 18 from the rear end of the launcher tube 11 at a kinetic energy level sufficient to bring the device clear of the tube 11 and clear of the efflux envelope of the motor 13 when the latter is fired but insufficient for the ejected closure device to be a hazard. Such adjustment can readily be made by advancing or retracting the arrestor nuts 33 on their studs 32.

The firing sequence for the discharge of the missile 12 is continued following the ejection of the closure device 18 and the first stage motor 13 is then fired to eject the missile forwardly from the launcher tube 11, following which the first stage motor 13 is discarded and the second stage motor fired.

The missile firing circuit may if desired include a microswitch 46 (FIG. 2) fitted between the rear face of the end plate 16 of the motor 13 and the base plate 20 so that when the closure device 18 disengages from the end plate 16 the switch 46 completes an electrical circuit enabling the firing sequence to continue.

The closure device as hereinbefore described with reference to the drawings has the following advantages:

(a) it provides secure lateral and longitudinal support of the missile 12 in the launcher tube 11;
(b) it provides a degree of shock and vibration isolation of the missile 12 from the launcher tube 11;
(c) it is self-propelled so as to be clear of the efflux envelope of the first stage motor 13 when a firing signal is applied to the motor 13;
(d) it has a level of kinetic energy which can be set at a minimum compatible with (c); and (e) it provides a fail-safe method of release.

In the embodiment of the invention described with reference to the drawings, the closure device 18 is applied to a missile and launcher tube for a shoulder-launched missile weapon system. It will however be appreciated that the closure device may with advantage be used when the launcher is mounted on a vehicle or installed on board ship to reduce the danger to personnel or equipment in the immediate vicinity.

In the embodiment of the invention described with reference to the drawings, the missile 12 is provided with first and second stage motors, the first stage motor 13 being used to eject the missile from the launcher tube and being so arranged as to be all burnt within the launcher tube so that it does not present a hazard to the operator holding the launcher in the shoulder mounted position, the second stage motor then being fired at a time when the missile is clear of the launcher. It will, however, be appreciated that where the launcher of the missile weapon system is used in a non-shoulder launch mode, the first and second stage motors of the missile can be replaced by a single stage motor.

In the embodiment of the invention described with reference to the drawings, the closure device 18 serves the dual purpose of closing off the rear end of the missile to provide protection for it during storage and transportation as well as providing support for the missile within the launcher tube. It will, however, be appreciated that the closure device may with advantage be used solely to close off the rear end of a missile otherwise launched.

Reference has been made throughout the specification to a missile for use in the missile weapon system according to the invention. The term missile is to be taken to include a unitary bodied missile for guidance to a target as well as an assembly of a carrier missile and a plurality of sub-missiles which are carried by it and which are subsequently launched from the carrier missile for guidance to the target.

We claim:

1. A missile weapon system comprising a missile launcher, a missile which is housed in the launcher and from which it is launched under thrust produced by efflux gases from a thrust motor of the missile, a closure device, securing means for securing the closure device in a closed position in which it closes off the rear end of the missile, and thrust generating means embodied in the closure device to apply a thrust to the closure device at the time the missile is fired to propel the device from the closed position to a remote position clear of the rear end of the missile, wherein the closure device comprises first and second elements displaceable relative to each other between a first disposition and a second disposition, wherein the securing means holds the closure device in the closed position and the first and second elements in the first disposition, wherein the thrust generating means generates thrust to cause the securing means to release the closure device and the first and second elements from the first disposition and to cause displacement of the first element relative to the second element to bring the elements to the second disposition, wherein arrestor means are provided to prevent further relative displacement of the first and second elements, whereby the momentum imparted to the first element by the thrust from the thrust generating means is imparted to the closure device to propel the closure device to the remote position at an initial velocity determined by the motion of the first element relative to the second element.

2. A system according to claim 1, wherein the thrust generating means generates thrust to cause ejection of the closure device from the rear end of the missile rearwardly and axially with respect to the missile.

3. A system according to claim 1, wherein the second element includes the arrestor means to arrest displacement of the first element in the second disposition of the elements, and wherein the arrestor means are adjustable to provide for an adjustment of the displacement of the first element in moving from the first disposition to the second disposition, thereby to provide for an adjustment of the initial ejection velocity of the closure device from the rear end of the missile.

4. A system according to claim 1, wherein the first and second elements together form an annular thrust chamber for pressurised gas and the thrust generating means comprises a gas generator for discharge of pressurised gas into the thrust chamber.

5. A system according to claim 4, wherein the second element of the closure device is in the form of a base plate and the first element is in the form of a domed cap which is arranged on the base plate for axial sliding with respect thereto between the first and second dispositions of the two elements.

6. A system according to claim 5, wherein the gas generator is mounted on the base plate and communicates with the thrust chamber through vents in a wall enclosing the generator.

7. A system according to claim 1, wherein the first element is located to the rear of the second element, wherein the securing means secures the first element to the rear end of the missile with the second element held captive against the rear end of the missile by the first element, and wherein the thrust generating means generates thrust to cause a rearward displacement of the first element relative to the second element.

8. A system according to claim 7, wherein the second element includes arrestor means to arrest displacement of the first element in the second disposition of the elements, and wherein the arrestor means comprises a plurality of arrestor members which are secured to the second element at equi-spaced positions around the rear end of the missile and pass through bores in the first element, each arrestor member carrying an arrestor part at such location on the arrestor member as to provide for displacement of the first element from the first disposition of the elements in which the first element is clamped to the missile and in which the second element bears against the rear of the missile, to the second disposition in which the rear face of the first element bears against the arrestor part.

9. A system according to claim 8, wherein each arrestor member comprises a stud which is screwed into the second element of the closure device and extends rearwardly through a bore in the first element of the device, with the arrestor part taking the form of an arrestor nut screwed on to the rear end of the arrestor stud projecting rearwardly from the first element, and wherein the arrestor nuts are adjustable to provide for an adjustment of the displacement of the first element in moving from the first disposition to the second disposition, thereby to provide for an adjustment of the initial ejection velocity of the closure device from the rear end of the missile.

10. A system according to claim 7, wherein the securing means comprises a plurality of retaining members which are secured to the rear end of the missile at equi-spaced positions around the rear end of the missile and extend through the first element and wherein the retaining members serve to clamp the first element to the rear end of the missile with the second element being held captive between the first element and the rear end of the missile.

11. A system according to claim 10, wherein the second element has a minimum axial freedom of movement with the first element clamped to the missile.

12. A system according to claim 10, wherein each retaining member comprises a locally weakened retaining screw which extends through the first element of the closure device and is screwed into a threaded bore in the rear end of the missile to bring a head of the screw to bear against a rear face of the first element and each retaining member is arranged to fracture at the locally weakened region when the first element is subjected to rearwardly directed thrust produced by the thrust generating means.

13. A system according to claim 1, wherein the missile launcher includes a launcher tube within which the missile is housed and from which it is launched under thrust produced by efflux gases from the thrust motor of the missile and the closure device then further serves in the closed position to close off the launcher at the rear end thereof.

14. A system according to claim 13, wherein the closure device further serves by engagement with the rear end of the launcher tube to provide support for the missile within the tube.

15. A system according to claim 14, wherein the closure device includes support means which engages the inner wall of the launcher tube to provide support for the missile against lateral and longitudinal displacements of the missile within the tube.

16. A system according to claim 15, wherein the support means is made resilient and serves to absorb shocks and vibration imposed upon the launcher tube during transportation.

17. A system according to claim 16, wherein the support means comprises a support ring made of a resilient material which extends around the closure device and which is forced into a circumferential groove formed in the inner wall of the tube, when the closure device is clamped to the rear end of the missile and takes up its closed position closing off the rear end of the missile.

* * * * *